United States Patent [19]

Lynn

[11] 4,308,123

[45] Dec. 29, 1981

[54] APPARATUS FOR THE SMALL-SCALE MANUFACTURE OF CHLORINE AND SODIUM HYDROXIDE OR SODIUM HYPOCHLORITE

[75] Inventor: Scott Lynn, Walnut Creek, Calif.

[73] Assignee: Hydro-Chlor International, Inc., San Jose, Calif.

[21] Appl. No.: 98,985

[22] Filed: Nov. 30, 1979

[51] Int. Cl.[3] ..... C25B 9/00

[52] U.S. Cl. ..... 204/266; 204/263; 204/265

[58] Field of Search ..... 204/98, 128, 263, 265, 204/266

[56] References Cited

U.S. PATENT DOCUMENTS

| | | | |
|---|---|---|---|
| 687,386 | 11/1901 | Schwerin | 204/131 |
| 3,222,267 | 12/1965 | Tirrell et al. | 204/98 |
| 3,523,880 | 8/1970 | Parsi | 204/98 |
| 3,524,801 | 8/1970 | Parsi | 204/98 |
| 3,775,272 | 11/1973 | Danna | 204/98 |

OTHER PUBLICATIONS

Electroplating Engineering Handbook by A. K. Graham, 1955, p. 410.

*Primary Examiner*—R. L. Andrews
*Attorney, Agent, or Firm*—John J. Leavitt

[57] ABSTRACT

Presented is an apparatus and method for producing small quantities of chlorine and sodium hydroxide or sodium hypochlorite, useful in many applications where the major investment of a full-blown chemical plant capable of producing tons of product per day is not economically feasible. The apparatus of the invention includes the use of an electrolytic cell embodying an anode chamber charged with an acidic, concentrated sodium chloride solution and a cathode chamber charged with a basic aqueous solution and through which an electric current may be passed under controlled conditions to initiate and maintain a reaction that produces chlorine gas in the anode chamber and hydrogen gas and a solution of sodium hydroxide in the cathode chamber. The anode and cathode chambers are separated by a chemically-resistant ion-exchange membrane permeable only to positively charged ions. Anolyte and catholyte feed tanks are arranged in association with appropriate anolyte and catholyte surge tanks connected to the electrolytic cell in such a way that the reaction proceeds continuously without the need for mechanical pumps. The chlorine and the sodium hydroxide solution may leave the apparatus as separate product streams, or, in a second aspect of the invention, may be combined to form (as yet another product) a solution of sodium hypochlorite.

12 Claims, 4 Drawing Figures

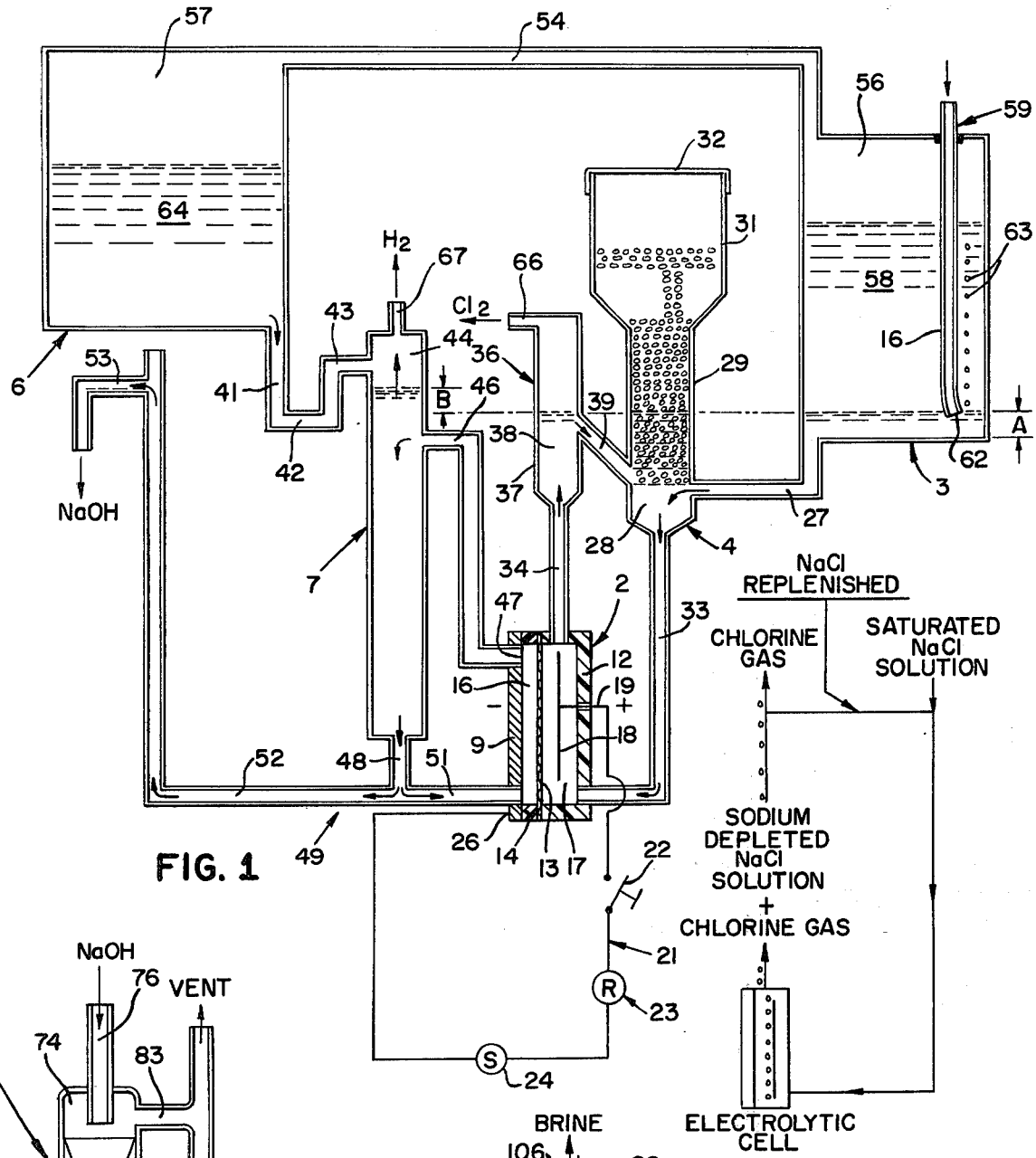
FIG. 1
FIG. 4
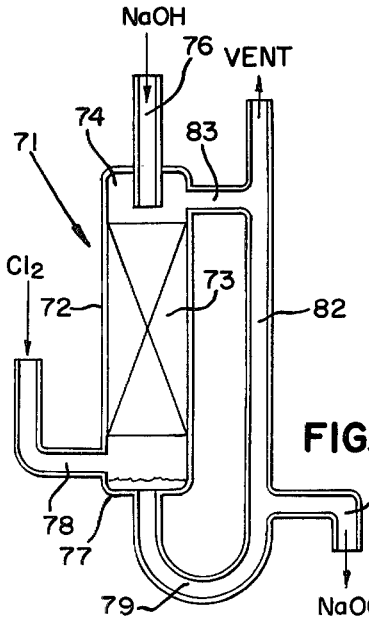
FIG. 2
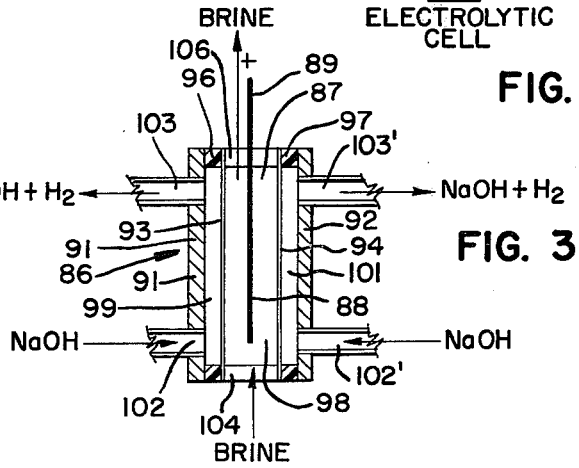
FIG. 3

APPARATUS FOR THE SMALL-SCALE MANUFACTURE OF CHLORINE AND SODIUM HYDROXIDE OR SODIUM HYPOCHLORITE

BACKGROUND OF THE INVENTION

Field of the Invention

This invention relates to apparatus and methods for the production of chlorine and sodium hydroxide, in one aspect of the invention, or sodium hypochlorite in another aspect, and particularly to a low-volume automatic production apparatus and methods.

The electrolysis of an aqueous solution of sodium chloride to produce chlorine gas and a solution of sodium hydroxide has been practiced commercially for many years. The prior art is repleat with patents disclosing many complex and expensive structures for manufacturing these products in terms of tons and even thousands of tons per day. Until recently, however, the complexity of industrial electrolyzers has made the use of small-scale units, having a capacity of less than five hundred pounds of chlorine per day, too costly to merit consideration. However, there are many defined needs for chlorine that require small amounts delivered in either a continuous stream or semi-continuously and on a daily basis. For instance, purification of swimming pools, disinfection of water supplies, the treatment of effluent from sewage plants and, in industrial application, the chlorination of water admitted to cooling towers are examples of the uses of chlorine for its cleansing and sterilizing abilities. In most cases the preferred form of chlorine is as an acidometrically neutral solution of sodium hypochlorite. So far as is known, there is not on the market an automatically operable, small-scale apparatus for the electrolytic production of chlorine and sodium hydroxide, or sodium hypochlorite, to satisfy these needs. At present these needs are being satisfied by using hazardous chlorine gas shipped in cylinders or expensive-to-ship sodium hypochlorite solution, the active ingredient in conventional household bleach. Accordingly, one of the important objects of this invention is the provision of an apparatus and method for the small-scale and continuous production of chlorine and sodium hydroxide, either separately or combined as a solution of sodium hypochlorite.

It sometimes happens that a technological development in one area spurs thinking and innovation in another area. Thus, the wartime development of atomic energy technologies has spurred the application of atomic energy technologies in many fields not related to war and combat. The so called "fallout" from research and development of devices and processes for use in sending humans into outer space and to other planets has generated many different products for use by the consumer. So, too, in the manufacture of chlorine gas and sodium hydroxide, the development for commercial use of the dimensionally-stable anode utilizing a titanium plate coated with ruthenium oxide and the chlorine-resistant cation-exchange membrane have greatly simplified the design of electrolyzers capable of converting an aqueous solution of sodium chloride into separate chlorine and sodium hydroxide streams with high efficiency. Accordingly, a still further object of the invention is the provision of apparatus utilizing a small, membrane-type electrolytic cell with a dimensionally-stable anode for the continuous, small-scale production of chlorine and sodium hydroxide or sodium hypochlorite.

As indicated above, there are many full-blown plants that produce chlorine gas and sodium hydroxide at rates measured in terms of tons per day. However, so far as is known, there is no reliable apparatus or method that will produce chlorine gas continuously and in such a small quantity as to be suitable for uses such as the purification of the water in a swimming pool. Accordingly, another important object of the present invention is the provision of an apparatus and method which will produce chlorine gas at a daily rate from approximately one-half pound to fifty pounds or more, say up to 500 pounds per day on a continuous basis and with no restriction in the flow thereof. Concurrently with the chlorine gas there is produced a solution of sodium hydroxide or, alternatively, a solution of sodium hypochlorite may be produced as the end product.

Another object of the present invention is the continuous or semi-continuous production of chlorine gas and sodium hydroxide on a small scale through use of an electrolytic cell in which only a relatively small fraction of the sodium chloride in the brine solution entering the anode chamber of the electrolytic cell is consumed, the portion that is not consumed being freely circulated and caused to mix with solid sodium chloride, a portion of which is dissolved to maintain the concentration of the sodium chloride solution.

In the production of chlorine and sodium hydroxide in commercial quantities by commercial producers, various aspects of the process are controlled through appropriate use of electrically operated pumps, control valves, flow monitors and other equipment commonly used in large chemical plants. The cost of this equipment in such a large plant is small relative to the value of the product produced when the latter is being produced at the rate of many tons per day. However, the use of such control equipment is prohibited by its expense in an apparatus calculated to produce chlorine at a rate less than 500 pounds per day. It would most certainly be prohibitive in cost for an apparatus expected to produce an amount of the order of only one-half pound to five pounds of chlorine per day, such as might be required for conventional-size swimming pools containing 20,000 to 200,000 gallons of water. Accordingly, another object of this invention is the provision of apparatus and a method for producing on a continuous or near-continuous basis small quantities of chlorine and sodium hydroxide, or sodium hypochlorite, without the need of expensive pumps, control valves, flow monitors and other equipment commonly used in large chlor-alkali plants for the production of large quantities of chlorine.

In the operation of a membrane-type electrochemical or electrolytic cell for the production of chlorine and sodium hydroxide, sodium ions are transported through the cation-exchange membrane from the anode compartment or chamber to the cathode compartment or chamber as the result of the flow of electric current through the cell. At the same time, water is reduced at the cathode to form hydrogen gas and hydroxide ions. Also, simultaneously, chloride ions are oxidized electrochemically at the anode to form chlorine gas. The sodium chloride content of the saturated brine solution in the anode compartment is thus depleted, forming an unsaturated brine solution, by the flow of electric current through the cell, and the sodium chloride content must be replaced to again bring the brine solution to a saturated condition. Accordingly, it is an object of the present invention to provide an apparatus and method by which flow of the unsaturated anolyte brine between the cell and a bed of solid sodium chloride is induced and maintained by the chlorine gas being formed at the anode.

In the operation of a membrane-type electrochemical cell there is also a transport of water from the anode compartment into the cathode compartment that accompanies the movement of the sodium ions. About three molecules of water pass through the membrane with each sodium ion. As is the case with the sodium ions, the rate of transport of water depends upon the magnitude of the electric current flowing through the cell. It is, therefore a further object of the invention to offset the transport of water through the membrane of the electrochemical cell by a flow of water from an anolyte feed tank provided for that purpose.

Together with the transport of water and sodium ions, there is also a diffusion of sodium hydroxide in the reverse direction through the membrane, from the cathode compartment to the anode compartment, that is induced by the flow of the electric current. The amount of sodium hydroxide diffusing through the membrane corresponds to about 10% of the amount being formed in the cathode compartment. If not neutralized by acid in the anode compartment, this sodium hydroxide will react with the chlorine being produced there to form sodium hypochlorite and sodium chlorate. Both of the latter compounds are undesirable in the anode compartment.

It is still another object of the invention to neutralize the sodium hydroxide that diffuses through the membrane into the anode compartment of the electrochemical cell with hydrochloric acid that is added to the water with which the anolyte feed tank is filled.

The sodium hydroxide that is formed in the cathode compartment of the membrane-type electrochemical cell must be diluted with water to a concentration of about 10% to 20% by weight NaOH for proper operation of the cell. The water that is transported through the membrane with the sodium ions is insufficient for this purpose, and additional water must be added to and mixed with the catholyte liquor to obtain the desired composition. The rate at which water must be added to the catholyte compartment is in constant proportion to the rate of transport of water through the cell membrane, and hence varies with the flow of electric current through the cell.

It is, therefore, a still further object of the present invention to provide for the flow of diluent (catholyte feed) water to the cathode compartment of the membrane-type electrochemical cell utilized in this invention in proportion to the flow of electric current through the cell.

It is a further object of the invention to provide for mixing the diluent water with the catholyte in a catholyte surge tank, and to circulate the catholyte between the surge tank and the cathode compartment by the action of the bubbles of hydrogen gas formed in the cathode compartment of the cell.

Still another object of the invention is to control the rate of feed of the water from the catholyte feed tank by interconnecting the vapor space of that tank and the anolyte feed tank, and by having the latter operate on the constant-head principle.

When chlorine is used as a bactericide and/or algaecide it is frequently desirable to keep the water to which it is added acidometrically neutral. For this reason it will frequently be desirable to add the chlorine to the water in the form of a solution of sodium hypochlorite that is about acidometrically neutral, i.e., contains about equal numbers of chemical equivalents of chlorine and sodium hydroxide (or sodium carbonate). In the case of a use in which some of the chlorine is lost to the atmosphere during normal operation, such as may occur in a swimming pool, it may be desirable to produce more equivalents of chlorine than of sodium hydroxide. In the case where the sodium hypochlorite solution may be stored for prolonged periods it may be desirable to have a small excess of sodium hydroxide (or sodium carbonate) to prolong shelf life.

When acidified brine is electrolyzed in the anode compartment of a membrane-type cell, part of the chlorine is derived from the sodium chloride in the brine and part derives from the hydrochloric acid. The number of acid equivalents of chlorine formed at the anode will exceed the net number of base equivalents produced by the cell by the number of acid equivalents that have been fed to the cell from the anolyte feed tank. The ratio of the number of base equivalents in the cell effluent to the acid equivalents of chlorine produced may be varied by adding sodium hydroxide or sodium carbonate to the water in the catholyte feed tank, since those compounds then pass through the cathode compartment unchanged.

Accordingly, it is an object of the present invention to produce a stream of chlorine gas and an aqueous stream containing sodium hydroxide (and, optionally, sodium carbonate) at rates that are chemically about equivalent.

It is a further object of this invention to provide a method of varying the ratio of base equivalents to acid equivalents in the streams leaving the cell by the addition of sodium hydroxide or sodium carbonate to the solution in the catholyte feed tank.

Pure chlorine gas reacts extremely rapidly with either sodium hydroxide or sodium carbonate in aqueous solution. The product of the reaction is a solution containing sodium hypochlorite, the active component in household bleach. The reaction may be carried out in any of a wide variety of gas-liquid contactors well known to those skilled in the art. A bleach solution is the most convenient form of chlorine for many uses. It is more easily handled than a gas and may readily be added to a swimming pool or other tank to purify the water therein. Whereas chlorine is a toxic, irritating, and corrosive vapor, a bleach solution has little odor and is therefore less obnoxious. Finally, chlorine is an acidic gas, and its addition to a water stream must be accompanied by the addition of a suitable base, usually sodium carbonate or sodium hydroxide, if the pH of the water is not to become more acidic.

It is, therefore, an object of the present invention to provide a method and means for the production of a solution of sodium hypochlorite by causing the gaseous chlorine and caustic solution issuing from the electrolytic cell to react in a suitable gas-liquid contactor to produce sodium hypochlorite.

In the electrolytic production of chlorine and sodium hydroxide in continuous or near continuous small quantities, it is an object of this invention to control all feed rates, flow rates, production rates, and other process parameters by controlling the current flow through the cell.

The invention possesses other objects and features of advantage, some of which, with the foregoing, will be apparent from the following description and the drawings. It is to be understood however, that the invention is not limited to the embodiment of the invention illustrated and described since it may be embodied in various forms within the scope of the appended claims.

SUMMARY OF THE INVENTION

In terms of broad inclusion, the invention comprises the combination of a relatively small electrolytic cell, incorporating a membrane permeable to sodium and hydrogen ions but effectively impermeable to chloride ions, with suitable anolyte and catholyte feed tanks interconnected with the electrolytic cell, appropriate anolyte and catholyte surge tanks, and a source of solid sodium chloride in such a manner that when electric current under controlled conditions is passed through the electrolytic cell chlorine gas is generated in the anode chamber while hydrogen gas and sodium hydroxide are generated in the cathode chamber. The circulation of a concentrated solution of sodium chloride between the anode chamber of the electrolytic cell and the anolyte surge tank which contains solid sodium chloride, is induced by the release of bubbles of chlorine gas from the anode, while the same principle, using hydrogen bubbles, is utilized to maintain the free circulation of diluent water into the cathode chamber so as to maintain the proper dilution of the sodium hydroxide therein. The efflux of water through the membrane from the anode chamber is offset by connecting the anolyte surge tank to the anolyte feed tank, which is equipped with a constant-head feed mechanism. Means are also provided connecting the vapor spaces of the anolyte and catholyte feed tanks to maintain the same air pressure within these tanks so that the flow of anolyte feed is automatically accompanied by a flow of catholyte feed to the catholyte surge tank.

BRIEF DESCRIPTION OF THE DRAWINGS

FIG. 1 is a schematic view illustrating the apparatus for the continuous production of small quantities of chlorine and sodium hydroxide, or sodium hypochlorite.

FIG. 2 is a schematic view illustrating connection of the system of FIG. 1 to a "scrubber" or gas absorber for production of sodium hypochlorite.

FIG. 3 is a schematic view illustrating an electrolytic cell having two cathodes and an anode common to both cathodes.

FIG. 4 is a schematic view illustrating the re-circulation of sodium chloride-depleted anolyte induced by rising chlorine gas bubbles.

BRIEF DESCRIPTION OF THE DRAWINGS

Referring to FIG. 1, there is there shown an electrolytic cell designated generally by the numeral 2, an anolyte feed tank designated generally by the numeral 3, an anolyte surge tank designated generally by the numeral 4, a catholyte feed tank designated generally by the numeral 6 and a catholyte surge tank designated generally by the numeral 7.

Referring specifically to the electrolytic cell 2, for purposes of proper conception as to the size of this equipment and specifically the size of the electrolytic cell, we have found that an electrolytic cell having a width ranging between 4 and 5 inches, approximately 10 inches high and about 1 inch thick produces satisfactory results. Structurally, the electrolytic cell 2 comprises a steel plate 9 constituting the cathode in the assembly and forming one side of the cell housing. The remainder of the cell housing is formed by a synthetic resinous shell 12 forming the opposite side of the hollow electrolytic cell. Sealingly sandwiched between the synthetic resinous shell 12 and the steel plate cathode 9 is a membrane 13 and a pliant gasket 14, these members being sandwiched sealingly between the synthetic resinous shell 12 and the cathode plate 9 by appropriate bolts, not shown. The membrane 13 is a commercially available, chlorine-resistant, cation-exchange membrane which possesses the characteristic of being permeable to sodium and hydrogen ions but impermeable to chloride ions.

As seen in the drawing, the hollow interior of the electrolytic cell 2 is divided by the membrane 13 into a cathode chamber or compartment 16 constituting the hollow space disposed between the cathode plate 9 and the left side of the membrane as seen in FIG. 1. The remaining portion of the interior of the electrolytic cell constitutes the anode chamber or compartment 17 and is disposed between the right side of the membrane 13 and the synthetic resinous shell 12 that forms a part of the housing of the electrolytic cell. Within the anode chamber or compartment 17 there is appropriately positioned an anode 18 that is preferably formed from thin titanium plate having a ruthenium oxide coating thereon, as is well known in the art. The anode 18 is essentially suspended within the anode chamber 17 and is provided with a lead 19 that extends sealingly through the housing wall 12 and which is connected to an electric circuit designated generally by the numeral 21 which includes a switch 22 and some appropriate type of rheostat 23 and a source 24 of direct electric current, with the opposite end of the circuit being appropriately connected as at 26 to cathode plate 9 so that when the electrolytic cell is appropriately charged with anolyte and catholyte, closing of the switch 22 causes a current of approximately 0.01 to 0.2 amperes/cm$^2$ of exposed membrane area, at 3 to 5 volts, to flow through the electrolytic cell to effect dissociation of the sodium chloride and water as will be explained hereinafter in greater detail.

It will be noted that the bottom of the anolyte feed tank 3 is connected by means of an appropriate conduit 27 with the bottom end portion 28 of the anolyte surge tank, which is preferably configured with an elongated portion 29 which opens upwardly into a hopper portion 31 having a lid 32 and into which hopper solid sodium chloride pellets may be loaded from time to time to replenish the dissolved sodium chloride depleted by the process, as will hereinafter be explained. The lower end portion 28 of the anolyte surge tank is connected by an appropriate conduit 33 with the lower end of the electrolytic cell and specifically with the interior of the anode chamber or compartment 17. Anolyte thus feeds by gravity from the anolyte feed tank through the conduit 27, through the lower end portion 28 of the anolyte surge tank and from there downwardly by gravity through the conduit 33 and into the interior of the anode chamber 17.

In actual practice, the anolyte feed tank and the anolyte surge tank are mounted in such a relationship that gravity causes the anolyte to feed downwardly through the lower portion of the anolyte surge tank and to ultimately fill the anode chamber 17. The upper end of the anode chamber 17 is connected by an appropriate conduit 34 with a bubble-disengagement chamber designated generally by the numeral 36 and including a lower portion 37 defining a chamber 38. As will be seen from the drawing, the chamber 38 is connected by an appropriate conduit 39 through which circulating anolyte in the form of concentrated sodium chloride solution passes in its circulation back to the lower end portion 28 of the anolyte surge tank. The relationship between the chamber 38, the conduit 39, the surge tank 4, and the anolyte feed tank 3 is such that the level of solution in the bubble-disengagement chamber is equal to that in surge tank 4 and is controlled in a manner which will hereinafter be explained. It should be noted that there are no mechanical or electrical pumps to effect such recirculation of concentrated sodium chloride solution in this recirculation loop. Rather, this recirculation of the concentrated sodium chloride solution is effected in a manner which will hereinafter be explained.

The opposite or cathode side of the electrolytic cell is appropriately connected to the catholyte feed tank by means of a conduit 41 connected to the bottom of the catholyte feed tank and providing a trap section 42 having a return portion 43 that connects into the interior of the upper end portion 44 of the catholyte surge tank 7. At a point spaced below the opening of the conduit 43 into the upper end portion 44 of the catholyte surge tank, a recirculation conduit 46 connects into the interior of the catholyte surge tank, the point of entry of this recirculation conduit 46 into the catholyte surge tank being below the level of the catholyte within the surge tank and above its entry 47 into the upper end of the cathode chamber 16 as shown. The lower end of the catholyte surge tank is connected by a conduit 48 to a conduit designated generally by the numeral 49, one portion 51 of which constitutes a recirculation conduit and is connected to the interior of the cathode chamber 16 at about the same level as the connection of conduit 33 into the anode chamber 17. The branch 52 of the conduit 49 extends in the opposite direction from the conduit 51 and terminates in an outlet 53 for a portion of the sodium hydroxide generated in the cathode chamber of the electrolytic cell.

Referring to FIG. 1 of the drawing, it will be noted that the catholyte feed tank and the anolyte feed tank are both closed or sealed chambers or containers and are interconnected by a conduit 54 that equalizes the pressures in the vapor spaces 56 and 57, respectively, of the anolyte and catholyte feed tanks. Additionally, so as to control the pressure within the space 56 above the liquid 58 in the anolyte feed tank, the anolyte feed tank is provided with a downwardly extending pressure control tube 59 the lower portion 61 of which is immersed in the liquid within the anolyte feed tank, and the lower open end 62 of which is spaced a predetermined distance A above the bottom of the tank.

It will thus be seen that as the anolyte is used and its upper level recedes, a partial vacuum is formed in the space 56 as liquid from the anolyte feed tank flows into the anolyte surge tank 29. Thus, atmospheric pressure acting through the pressure control tube 59, causes air bubbles 63 to emanate from the lower end 62 of the pressure control tube 59 and to rise upwardly through the liquid into the vapor space 56 above the liquid when the pressure differential between atmospheric pressure and the reduced pressure in space 56 exceeds the pressure head exerted by the liquid at the lower end 62 of the tube. Since the vapor space 56 is interconnected with the vapor space 57 in the catholyte feed tank there occurs an equalization of pressure in the air spaces in these two tanks.

Since there is a correlation between the height of the liquid above the tube outlet 62 and the differential pressure between atmospheric and the space 56, it is found that by controlling the elevation of the open end 62 of the pressure control tube 59 in relation to the bottom of the anolyte feed tank (dimension A) it is possible to control the pressures in feed tank spaces 56 and 57 and thereby control the rates of feed of both anolyte and catholyte. Through this means it is also possible to control the level of the anolyte in the bubble-disengagement chamber 36 so that the level of anolyte in the anolyte surge tank and in the bubble-disengagement chamber equal one another and correspond to the level of the lower end 62 of the pressure control tube 59 in the anolyte feed tank. It is important to note that the same pressure differential principle that causes bubbles to emanate from opening 62 of tube 59 also allows the level of anolyte in the surge tank and in the bubble-disengagement chamber to be maintained constant while the level of the liquid in the anolyte feed tank is falling. These relationships are important to the principle utilized by applicant for circulation of the anolyte without the need of pumps because it ensures a constant "head" on the anolyte.

Again referring to FIG. 1 of the drawings, and specifically to the relationship of the catholyte feed tank to the catholyte surge tank and the outlet 53 for the sodium hydroxide, it should be noted that the rate of feed of the liquid 64 from the catholyte feed tank is controlled entirely by the reduced, or less-than-atmospheric, pressure within the vapor space 57 above the liquid in the catholyte feed tank and not by the level of the catholyte within the catholyte surge tank. It should also be noted that the liquid from the catholyte feed tank enters the upper end of the catholyte surge tank, which is open to the atmosphere, at a point above the level of the catholyte in the tank. The level of the liquid catholyte within the catholyte surge tank lies above the level of the anolyte in the anolyte surge tank and in the bubble-disengagement chamber 36 by a distance B, which is equivalent to the difference in height between the open end 62 of tube 59 and conduit 53, the outlet for the sodium hydroxide solution being produced in the cell 2. The level of the catholyte within the catholyte surge tank is controlled by and is equal to the elevation of the outlet 53 for the sodium hydroxide.

Having thus described the structural relationships of the anolyte feed circuit and the catholyte feed circuit, it is important to understand the principles by which circulation of the anolyte and catholyte is accomplished without benefit of mechanical or electrically driven pumps. Again referring to FIG. 1, it is noted that as the anolyte passes downwardly through the conduit 27 and fills the lower portion of the anolyte surge tank to the level indicated and controlled by the lower end of the pressure control tube 59, solid sodium chloride within the lower portion of the anolyte surge tank is dissolved to saturate the diluent, which may be water, and passes downwardly through the conduit 33 into the anode chamber 17. Because of the level of the anolyte in the anolyte feed tank, and because of the less-than-atmospheric pressure within the vapor space 56 within the tank, the anolyte within the feed tank exerts a certain predetermined pressure or "head" on the anolyte admitted to the anode chamber 17.

This head is responsible for filling the anode chamber 17 and the conduit 34 leading therefrom into the bubble-disengagement chamber so that the levels of the anolyte within the bubble-disengagement chamber and in the anolyte surge tank reach equal levels controlled by the level of the lower end 62 of the pressure control tube 59. This is the state or condition of the anolyte feed circuit before the electrolytic cell is energized by the passage of an electric current therethrough.

The same principles apply in the catholyte feed circuit in which the level of the catholyte in the catholyte surge tank is controlled by the outlet 53 through which sodium hydroxide is discharged from the system. Again there is a continuous circular liquid path from the bottom of the catholyte surge tank over to and up through the cathode chamber of the electrolytic cell and back to the catholyte surge tank. This circuit is completely filled with liquid up to the level set by the outlet 53 before the cell is energized.

To secure automatic feed of the anolyte and catholyte through the electrolytic cell, electricity in the form of direct current is caused to flow through the electrolytic cell. The passage of an electric current through the cell causes the simultaneous occurrence of several phenomena. In the anode chamber, sodium ions are caused to be transported through the cation-exchange membrane 13 and into the cathode compartment. Simultaneously, water is reduced at the cathode 9 to form hydrogen gas and hydroxide ions. Additionally, chloride ions are oxidized electrochemically at the anode to form chlorine gas. The passage of the sodium ions from the anode compartment to the cathode compartment causes a depletion of the sodium chloride content of the brine in the anode compartment, which must be replenished on an automatic basis and in proportion to the amount of current that is passing through the electrolytic cell.

This replenishment is accomplished by causing the anolyte to re-circulate and thus cause fresh, concentrated anolyte to pass into the anode chamber continuously. Such recirculation is caused by the fact that the chlorine gas produced at the anode forms bubbles in the anolyte, thus decreasing the density thereof below the density of the fresh and fully saturated anolyte flowing toward the electrolytic cell through the conduit 33. Since the anolyte feed tank provides a predetermined constant "head" as previously discussed, and since the anolyte within the electrolytic cell has now been reduced in density by the formation of chlorine gas bubbles which rise through the conduit 34, it will be apparent that formation of the chlorine gas bubbles and their movement upwardly into the bubble-disengagement chamber 36 initiates and promotes the recirculation of the anolyte through the anolyte feed circuit without the need for extraneous pumping equipment.

The anolyte passing upwardly through the conduit 34 into the bubble-disengagement chamber 36 is not only of lesser density but is also depleted in its content of sodium chloride by virtue of the sodium ions that have passed through the membrane 13 and the chloride ions that have been converted into chlorine. It might be said, for instance, that in this part of the anolyte feed circuit the sodium chloride solution is "unsaturated" and that before it is re-introduced to the electrolytic cell it must be re-saturated with additional sodium chloride. This is accomplished, as illustrated in FIG. 1, by causing the unsaturated sodium chloride solution passing upwardly through the bubble-disengagement chamber to spill over through the conduit 39 into the anolyte surge tank where it comes into contact with and immerses solid sodium chloride pellets, dissolving the same, and becoming saturated once again with sodium chloride while being replenished also with fresh diluent from anolyte feed tank 3 and circulates through the system. In one aspect of the invention, the chlorine gas that rises as bubbles through the bubble-disengagement chamber 36 emanates from that chamber through an outlet 66 for disposition in a manner which will hereinafter be explained.

The opposite side of the system, namely, the catholyte feed circuit, operates in substantially the same way utilizing substantially the same principle. Thus, with the cathode compartment 16 filled with liquid from the catholyte feed tank 6, energizing the electrolytic cell by the passage of an electric current therethrough causes water in this cathode compartment to be reduced at the cathode to form hydrogen gas and hydroxide ions. The hydroxide ions combine with sodium ions coming through the membrane to form sodium hydroxide.

The sodium hydroxide mixes with the catholyte and proceeds upwardly with the hydrogen gas bubbles that are also produced in the cathode chamber 16. Thus, as before, the formation of the hydrogen gas bubbles in the cathode chamber 16 reduces the density of the solution in this chamber, and the bubbles rising through the recirculation conduit 46 induce and promote flow of the sodium hydroxide solution with them and both pass into the catholyte surge tank 7 where it mixes with the diluant from the catholyte feed tank. Because of the density of the sodium hydroxide, the sodium hydroxide moves downwardly through the catholyte surge tank. A major portion of it flows through the branch circuit 51 back into the cathode chamber, while the remainder flows through the outlet conduit 52 to the outlet 53.

The hydrogen gas that moves between the cathode chamber and the catholyte surge tank with the sodium hydroxide passes upwardly through an outlet 67 as shown, to be collected or utilized, or merely dissipated. It is thus seen that through the passage of direct electric current through the electrolytic cell, not only is the anolyte feed circuit activated by the generation of chlorine gas bubbles in the anode chamber, but the catholyte feed circuit is also energized by the generation of hydrogen gas bubbles in the cathode chamber 16. Both of these circuits then automatically re-circulate their respective solutions without the need of mechanical or electrical pumps.

There is a tendency for a portion of the sodium hydroxide to diffuse back through the membrane in reverse from the cathode compartment into the anode compartment. The amount of sodium hydroxide diffusing through the membrane corresponds to only about 10% of the amount being formed in the cathode compartment. As explained above, the sodium hydroxide diffusing back through the membrane in a reverse direction will react with the chlorine being produced in the anode compartment to form sodium hypochlorite and sodium chlorate if the sodium hydroxide is not neutralized before such reaction takes place. Such neutralization is effected by the addition of predetermined amounts of hydrochloric acid to the water in the anolyte feed tank when that tank is filled at infrequent intervals.

It is contemplated by this invention that at times it will be desirable to make a selection as to whether or not chlorine gas and sodium hydroxide as produced by the system are separately collected and utilized. It may be desirable, for instance, to combine the chlorine gas and sodium hydroxide in such a manner as depicted in FIG. 3 for the purpose of producing desirable small quantities of sodium hypochlorite. As indicated above, sodium hypochlorite is the active ingredient in household bleach and is the most expensive component of such bleach. There is therefore a ready market for this product, and the system depicted herein provides the source materials and the apparatus for the production of such a product on a small scale.

Referring to FIG. 2, there is illustrated a "scrubber", or gas absorber, designated generally by the numeral 71 and constituting a container 72 within which is included a large-surface-area medium 73. The large-surface-area medium is any type of a medium, or packing, that will provide a multiplicity of surfaces over which a liquid may flow while in contact with a gas. In the present instance, the "scrubber" 71 is connected at its upper end 74 by an inlet conduit 76 the other end of which is connected to the source of sodium hydroxide emanating from the system at 53 as illustrated in FIG. 1. Additionally, the bottom end 77 of the "scrubber" is provided with an inlet conduit 78 the opposite end of which is connected to the outlet 66 in the system depicted in FIG. 1 from which chlorine gas emanates. The purpose of the "scrubber" is to provide an environment in which the chlorine gas may contact and be absorbed by the sodium hydroxide to thus produce a sodium hypochlorite solution. As the chlorine gas flows into the bottom of the scrubber and rises, it passes upwardly through the large-surface-area medium 73 and in so doing comes in contact with and is absorbed by the sodium hydroxide solution that is passing downwardly through the packing medium 73.

In most instances, it has been found that the volumes of sodium hydroxide and chlorine gas can be controlled so that all of the chlorine gas is absorbed by the sodium hydroxide solution. The combined sodium hydroxide and chlorine gas in the form of sodium hypochlorite progresses downwardly and is discharged from the system through a trap 79 and an outlet 81 through which the sodium hypochlorite is discharged into an appropriate container. The outlet 81 is vented through a conduit 82 as illustrated which serves to vent off any chlorine gas that might not have been absorbed by the sodium hydroxide. Such vented chlorine gas as might emanate from the vent tube 82 may be collected in an appropriate container, or dissipated in a safe manner. Note also that the vent tube 82 is connected through a lateral branch 83 with the top end of the container 72 so that chlorine gas passing upwardly into the chamber above the large surface medium 73 may emanate through the vent branch 83 and the primary vent tube 82.

The invention as described above in FIG. 1, contemplates the utilization of an electrolytic cell having a single anode and a single cathode, the cell being divided into a cathode compartment and an anode compartment by the membrane 13. It should be understood that the electrolytic cell may be embodied in the form illustrated in FIG. 3 and designated generally by the numeral 86. As there shown, a single anode chamber 87 is provided having therewithin a single anode 88, the lead 89 of which is connected into the circuit as illustrated in FIG. 1. The cell illustrated in FIG. 3 differs from the cell illustrated in FIG. 1 in that two cathode plates 91 and 92 are provided on opposite sides of the anode and form the sides of the cell housing, with the single anode 88 within the hollow interior of the housing being separated from the cathodes 91 and 92 by membranes 93 and 94 similar to membrane 13 in FIG. 1. The membranes are separated and held in spaced relationship to the associated cathodes and the anode by appropriate seals or gasket means 96 and 97 as shown, these being formed from a pliant material such as neoprene and being disposed between each cathode plate and an associated membrane so as to define between the membranes 93 and 94, an anode chamber 98 within which the anode 88 is suspended, while defining between each of the membranes and an associated cathode plate, cathode chambers 99 and 101 corresponding in function to the cathode chamber 16 in the embodiment illustrated in FIG. 1.

To supply catholyte to the cathode chambers 99 and 101, these chambers are provided with inlets 102 and 102', respectively. To provide for the passage of catholyte out of the electrolytic cell, the cathode chambers 99 and 101 are also provided with outlet passages 103 and 103', respectively, through which pass the sodium hydroxide solution and the hydrogen gas into appropriate conduits (not shown) such as the conduit 46 in the embodiment depicted in FIG. 1.

With respect to the anode chamber 98, the lower end of the electrolytic cell is provided with an inlet 104 which might appropriately be connected to an inlet conduit (not shown) such as the conduit 33 in FIG. 1, while the opposite or upper end of the anode chamber is provided with an outlet 106 adapted to be connected to an appropriate conduit (not shown) such as the conduit 34 which carries the sodium chloride-depleted sodium chloride solution and chlorine gas into the bubble-disengagement chamber 36 as previously described.

It will thus be understood that the double-cathode electrolytic cell illustrated in FIG. 3 utilizes the costly anode plate more effectively than the single cathode version illustrated in FIG. 1, while operating on the same principles.

It has been found preferable that the apparatus and method illustrated in FIG. 1 above and described herein be operated on a continuous basis with only minimal attendance to the replenishment of certain materials expended during the operation of the apparatus. As indicated above, sodium ions are transported through the cation-exchange membrane 13 in FIG. 1 and membranes 93 and 94 in FIG. 3 from the anode compartment to the cathode compartment as a consequence of a direct electric current flowing through the cell. It has been found that there is also a transport of water from the anode compartment into the cathode compartment that accompanies the movement of the sodium ions. Approximately three molecules of water pass through the membrane with each sodium ion. The rate of transport of water, therefore, depends upon the magnitude of the direct electric current flowing through the cell, and depletes the amount of water in the anolyte, thus necessitating from time-to-time replenishment of the water supply in the anolyte feed tank.

It has also been found that the catholyte in the catholyte feed tank is also depleted and that from time-to-time, say once every three weeks or a month, liquid must also be added to the catholyte feed tank. Because of the reverse diffusion of sodium hydroxide through the membrane from the cathode compartment into the anode compartment, it is necessary to neutralize the effect of such additional sodium hydroxide in the anode compartment and to accomplish this, a quantity of hydrochloric acid is added to the anolyte feed tank each time that tank is replenished with water which, with the apparatus illustrated, may be every three or four weeks. It has been found that the amount of hydrochloric acid added to the anolyte feed water may be in the range of about two mols per liter of water. Since the addition of this hydrochloric acid to the anolyte feed tank renders the anolyte acidic in nature, and since it is desirable that the level of acidity of the anolyte be balanced with the basicity of the catholyte, I have found that such balance may be maintained by adding to the catholyte feed water each time it is replenished an appropriate quantity of sodium hydroxide or sodium carbonate, since those compounds then pass through the cathode compartment unchanged, as previously discussed.

From the foregoing it will be apparent that I have provided an apparatus and method that not only makes it feasible but highly desirable to produce small quantities of chlorine gas either for direct use in water systems as discussed above, or for use in combination with sodium hydroxide, also produced by operation of the system, to produce sodium hypochlorite, the active ingredient in household bleach.

Having thus described the invention, what is considered to be novel and sought to be protected by letters patent of the United States is as follows:

I claim:

1. Apparatus for the manufacture of chlorine and sodium hydroxide, comprising:

(a) an electrolytic cell through which electric current may be passed, said electrolytic cell including an anode compartment and a cathode compartment disposed on opposite sides of a chlorine-resistant cation-exchange membrane, a cathode surface operatively associated with said cathode chamber, and an anode operatively associated with said anode chamber;

(b) an anolyte feed tank;

(c) an anaolyte surge tank connected to said anolyte feed tank and to said anode chamber;

(d) a chlorine bubble disengagement chamber connected to said anode compartment and said anolyte surge tank and adapted to receive chlorine gas bubbles and sodium chloride-depleted anolyte from said anode compartment;

(e) a catholyte feed tank;

(f) a catholyte surge tank connected to said catholyte feed tank and to said cathode chamber;

(g) means interconnecting said catholyte feed tank and said anolyte feed tank to maintain proportional rates of feed from said tanks;

(h) means connected to said chlorine bubble disengagement chamber for delivery therefrom of chlorine gas; and (i) means connected to said catholyte surge tank for delivery therefrom of sodium hydroxide.

2. The combination according to claim 1, in which said chlorine bubble disengagement chamber, said anolyte surge tank and said anode chamber are connected in such a manner that gas bubbles formed in said anode chamber pass into said chlorine bubble disengagement chamber and thereby create a pumping action whereby brine is continuously circulated between said anolyte surge tank and said anode chamber.

3. The combination according to claim 1, in which said catholyte surge tank and said cathode chamber are connected in such a manner that gas bubbles formed in said cathode chamber pass into said catholyte surge tank and thereby create a pumping action to continuously circulate catholyte through said cathode chamber.

4. The combination according to claim 1, in which hopper means are provided for dispensing solid salt to said anolyte surge tank by gravity flow in response to a portion of said solid salt being dissolved in said surge tank by the sodium chloride-depleted brine circulated to said anolyte surge tank, said sodium chloride-depleted brine being circulated continuously from said anode chamber to said anolyte surge tank.

5. The combination according to claim 1, in which said electrolyte cell comprises an enclosed chamber defined on one side by an electrically conductive plate constituting a cathode and on the opposite side by a synthetic resinous cover and a chlorine-resistant cation-exchange membrane sealingly disposed between said electrically conductive cathode and said synthetic resinous shell to divide the interior of said electrolytic cell into an anode chamber disposed between said membrane and said synthetic resinous shell and a cathode chamber disposed between said membrane and said electrically conductive cathode, an anode disposed within said anode chamber and including electrically conductive lead means extending out of said electrolytic cell, and an electric circuit connecting said anode and said cathode so as to selectively pass an electric current through said electrolytic cell.

6. The combination according to claim 1, in which the cathode surface of said electrolytic cell is formed by a steel plate constituting one wall of said cathode compartment.

7. The combination according to claim 1, in which constant-head means is provided in said anolyte feed tank whereby anolyte flows by gravity into the anode chamber.

8. The combination according to claim 1, in which said anolyte and catholyte feed tanks each include an air chamber therewithin, and means interconnecting the air chambers in said anolyte and catholyte feed tanks to equalize the pressure therewithin whereby the rate of feed of said anolyte and said catholyte are maintained proportional.

9. The combination according to claim 1, in which said anolyte and catholyte feed tanks constitute sealed enclosures containing predetermined quantities of liquid anolyte and catholyte, respectively, an air chamber in each anolyte and catholyte feed tank above the liquid therewithin, constant head means in said anolyte feed tank responsive to the pressure in said air chamber therewithin for admitting air to said air chamber to adjust the pressure therewithin whereby the anolyte flows by gravity under a constant head into said anode chamber.

10. The combination according to claim 1, in which said electrolytic cell comprises an enclosed chamber defined on opposite sides by a pair of spaced plates electrically connected with each other to form a pair of spaced cathodes, a pair of spaced chlorine-resistant cation-exchange membranes within said enclosure disposed between said spaced cathodes, said membranes being spaced apart to define an anode chamber therebetween and associated with said spaced cathode plates to define a separate cathode chamber within said enclosure adjacent each cathode plate, said catholyte feed tank being connected to both said cathode chambers, and said cathode surge tank being connected to both said cathode chambers and said catholyte feed tank.

11. The combination according to claim 1, in which means are provided to receive and admix liquid sodium hydroxide delivered from said catholyte surge tank with chlorine gas delivered from said anode chamber to form sodium hypochlorite, and means for delivery of said sodium hypochlorite.

12. As an article of manufacture, an electrolytic cell, comprising:

(a) a housing having a hollow interior defined by side and end walls, said side walls (91,92) constituting two electrically conductive cathode plates spaced apart, and a pair of chlorine-resistant cation-exchange membranes (92,94) are provided within the hollow interior defining one anode chamber—(98) and two cathode chambers (99, 101), one each of said membranes (93,94) and one each of said cathode chambers (99, 101) being associated with each of said cathode-forming plates (91, 92);

(b) an anode in said anode chamber adapted to be connected into an electrical circuit including said cathode;

(c) inlet means communicating with said anode and cathode chambers through which anolyte and catholyte, respectively, may be admitted to said chambers; and (d) outlet means communicating with said anode and cathode chambers through which chlorine gas may be delivered from said anode chamber and hydrogen gas and liquid sodium hydroxide delivered from said cathode chamber.

* * * * *